US010428542B1

(12) United States Patent
Jackson et al.

(10) Patent No.: US 10,428,542 B1
(45) Date of Patent: Oct. 1, 2019

(54) METHOD OF CONSTRUCTING AN IN-GROUND SWIMMING POOL AND RELATED FORM SYSTEM

(71) Applicant: JACKSON POOLS, INC., Fort Myers, FL (US)

(72) Inventors: Chad Jackson, Fort Myers, FL (US); Richard Cox, Fort Myers, FL (US)

(73) Assignee: Jackson Pools, Inc., Fort Myers, FL (US)

( * ) Notice: Subject to any disclaimer, the term of this patent is extended or adjusted under 35 U.S.C. 154(b) by 0 days.

(21) Appl. No.: 15/994,449

(22) Filed: May 31, 2018

(51) Int. Cl.
*E04B 1/00* (2006.01)
*E04H 4/00* (2006.01)
*E04H 4/14* (2006.01)

(52) U.S. Cl.
CPC ..... *E04H 4/005* (2013.01); *E04H 4/14* (2013.01); *E04H 2004/146* (2013.01)

(58) Field of Classification Search
CPC ..... E04H 4/005; E04H 4/14; E04H 2004/146
USPC ..... 52/169.7, 416, 419, 426
See application file for complete search history.

(56) References Cited

U.S. PATENT DOCUMENTS 1,067,420 A * 7/1913 Forbis ..... E01C 19/506 249/5
1,816,921 A * 8/1931 Urschel ..... E04G 17/12 249/155
2,180,842 A * 11/1939 Winding ..... E01C 19/506 249/155
2,614,311 A * 10/1952 Shook ..... E04G 11/12 249/27
2,635,320 A * 4/1953 Ornitz ..... E04G 13/00 249/155
2,973,567 A * 3/1961 Brow, Jr. ..... E04G 13/00 249/207
3,207,465 A * 9/1965 Papin ..... E04G 13/00 249/34
3,317,925 A 5/1967 Vance
3,610,564 A 10/1971 Mattingly
3,662,985 A * 5/1972 Parker ..... E04G 13/00 249/194
3,739,539 A 6/1973 Posnick
(Continued)

OTHER PUBLICATIONS

Frank Wall Enterprises, LLC; "What is the Aquaform Difference?;" Website: www.frankwall.com/aquaforms/; pp. 1-18; retrieved Feb. 18, 2019.

*Primary Examiner* — Basil S Katcheves
(74) *Attorney, Agent, or Firm* — Allen, Dyer, Doppelt + Gilchrist, P.A.

(57) ABSTRACT

A method of constructing an in-ground swimming pool may include positioning outer form panels in side-by-side relation defining an outer form wall within an excavated area of ground corresponding to a desired in-ground swimming pool shape. Each outer form panel may have opposing inner and outer sides and a support member bracket extending from the outer side. The method may also include positioning inner form panels in side-by-side relation and in spaced relation from the inner side of the outer form panels to define an inner form wall. The inner and outer form walls may define a wall space therebetween, and each inner form panel may have opposing inner and outer sides. The method may also include coupling support members over the wall space and to the outer side of the inner form panels and to respective ones of the support member brackets.

18 Claims, 13 Drawing Sheets

(56) References Cited

U.S. PATENT DOCUMENTS 3,748,810 A 7/1973 Mattingly
3,906,688 A 9/1975 Witte
4,066,237 A * 1/1978 Bentz ..... E01C 19/502 249/208
4,090,266 A 5/1978 Price
4,263,759 A 4/1981 Miller
4,291,858 A * 9/1981 NeSmith ..... E04G 17/0758 249/216
4,339,106 A * 7/1982 Navarro ..... E04G 17/12 249/219.1
4,443,982 A * 4/1984 Dalbanne ..... E04H 4/0043 52/169.7
4,494,725 A * 1/1985 Sims ..... E04G 17/12 249/2
4,915,345 A * 4/1990 Lehmann ..... E04G 11/062 249/10
5,038,541 A * 8/1991 Gibbar, Jr. ..... E04B 2/8652 52/295
5,156,753 A * 10/1992 Speidel ..... B28B 7/02 249/159
5,400,555 A 3/1995 Kantor
5,547,163 A * 8/1996 Lack ..... E04G 13/00 249/216
5,782,050 A * 7/1998 Boeshart ..... E04B 2/8652 249/213
6,173,937 B1 * 1/2001 Cottongim ..... E04G 17/045 249/190
6,390,440 B1 * 5/2002 Morin ..... E04G 13/00 249/219.1
6,412,247 B1 * 7/2002 Menchetti ..... E04B 2/7411 52/481.1
7,229,062 B1 * 6/2007 Rascon ..... E04G 13/00 249/218
7,841,576 B2 * 11/2010 Miller ..... E01C 19/502 249/208
8,261,503 B2 * 9/2012 Meyer ..... E04G 21/28 52/357
8,555,583 B2 * 10/2013 Ciuperca ..... B23P 11/00 52/309.11
2002/0178676 A1 * 12/2002 Yost ..... E04B 2/8635 52/426
2003/0101670 A1 * 6/2003 Gustin ..... E02D 27/02 52/293.1
2006/0137273 A1 * 6/2006 Baker ..... B28B 7/0011 52/426
2006/0277851 A1 12/2006 Hudon et al.
2011/0131911 A1 * 6/2011 McDonagh ..... E04G 11/062 52/426
2011/0265414 A1 * 11/2011 Ciccarelli ..... E04B 2/8635 52/426
2012/0073229 A1 * 3/2012 Castonguay ..... E02D 29/0225 52/426
2014/0157704 A1 * 6/2014 McDonagh ..... E04G 11/062 52/426
2015/0159339 A1 * 6/2015 Castonguay ..... E02D 29/0225 405/284

* cited by examiner

METHOD OF CONSTRUCTING AN IN-GROUND SWIMMING POOL AND RELATED FORM SYSTEM

TECHNICAL FIELD

The present embodiments are directed to the field of swimming pools, and more particularly, to swimming pool construction and related methods.

BACKGROUND

A swimming pool is a relatively popular structure for swimming or other leisure activities. One type of swimming pool is an in-ground swimming pool. In one type of in-ground swimming pool, walls, typically metal or plastic are installed into an excavated area. The walls each typically have a same height. In other words, the walls do not vary in height to extend to a "deep end" depth. Foam padding may be placed over the walls to define the inside walls of the swimming pool. Sand may be positioned and smoothed to define the floor of the pool. A liner, typically vinyl, is installed over the foam or inside walls of the pool, and floor of the pool over the sand.

Another type of in-ground swimming pool includes the use of cement for forming the walls and floor. More particularly, a minimal wood frame is constructed within an excavated area. Metal or steel rebar, for example, in an interlaced or wire mesh fashion, is used to define the walls and floor of the pool (i.e., define the form). Gunite, shotcrete, or sprayed concrete is sprayed into form or floor and walls and permitted to harden. A pool finish is then added, for example, sprayed, over the sprayed concrete.

SUMMARY

A method of constructing an in-ground swimming pool may include positioning a plurality of outer form panels in side-by-side relation defining an outer form wall within an excavated area of ground corresponding to a desired in-ground swimming pool shape. Each outer form panel may have opposing inner and outer sides and a support member bracket extending from the outer side. The method may also include positioning a plurality of inner form panels in side-by-side relation and in spaced relation from the inner side of the plurality of inner form panels to define an inner form wall. The inner and outer form walls may define a wall space therebetween, and each inner form panel may have opposing inner and outer sides. The method may further include coupling a plurality of support members over the wall space and to an outer side of the plurality of inner form panels and to respective ones of the plurality of support member brackets.

The method may further include removing the plurality of outer and inner wall panels, for example. Each of the plurality of support members may include a base member and a plurality of arms extending outwardly from the base member.

Coupling the plurality of support members to respective ones of the plurality of support member brackets may include slidably positioning one of the plurality of arms within a corresponding one of the support member brackets. Coupling the plurality of support members to an inner side of the plurality of inner form panels may include clamping one of the plurality of arms to a respective one of the plurality of inner form panels, for example.

The method may further include positioning a plurality of spacers within the wall space to maintain spacing between the plurality of inner and outer wall panels. The method may also include excavating the ground prior to positioning the plurality of outer and inner form panels to define the excavated area, for example.

The method may also include injecting cement within the wall space to partially fill the wall space. The method may further include allowing the cement to cure to support filling remaining portions of the wall space with the cement and filling the remaining portions of the wall space with the cement, for example.

The method may also include removing the plurality of inner and outer wall panels based upon curing of the cement within the remaining portions of the wall space. Positioning the plurality of outer and inner form panels may include positioning the plurality of outer and inner form panels to be spaced above the ground in the excavated area.

Injecting the cement within the wall space to partially fill the wall space may include injecting cement within the wall space to permit the cement to flow from a bottom thereof to define a floor of the in-ground swimming pool, for example. The method may further include forming a plurality of post openings in the ground adjacent a perimeter of the desired area, inserting a plurality of support posts within the plurality of post openings, and coupling the plurality of outer form panels to the plurality of support posts.

An apparatus aspect is directed to a form system for an in-ground swimming pool. The form system may include a plurality of outer form panels in side-by-side relation defining an outer form wall within an area of ground corresponding to a desired in-ground swimming pool shape. Each outer form panel may have opposing inner and outer sides and a support member bracket extending from the outer side. The form system may further include a plurality of inner form panels in side-by-side relation and in spaced relation from the inner side of the plurality of inner form panels to define an inner form wall. The inner and outer form walls may define a wall space therebetween, and each inner form panel may have inner and outer sides. The form system may also include a plurality of support members over the wall space and coupled to an outer side of the plurality of inner form panels and to respective ones of the plurality of support member brackets.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
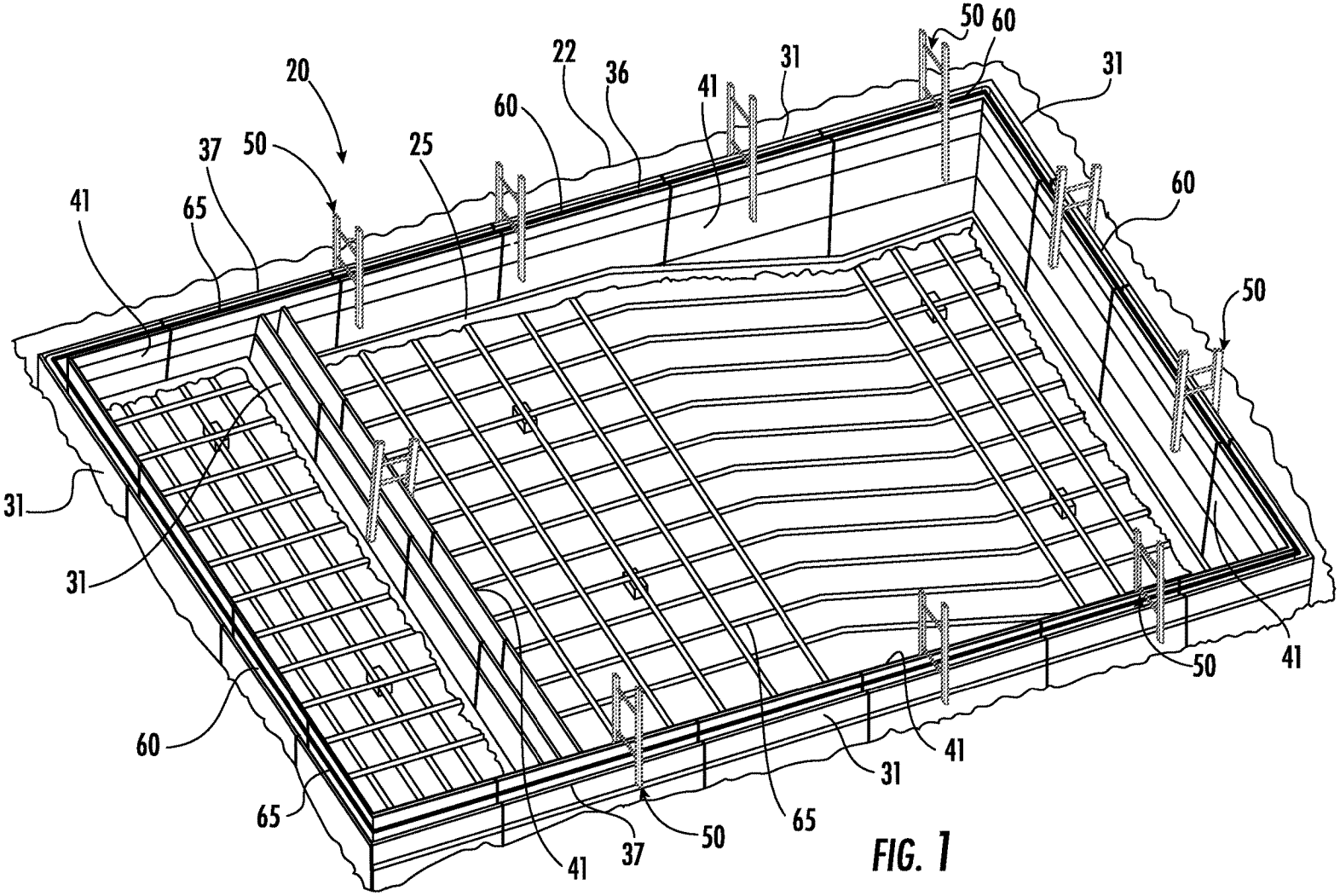
FIG. 1 is a schematic diagram of an in-ground swimming pool including a form system according to an embodiment.
Figure 2:
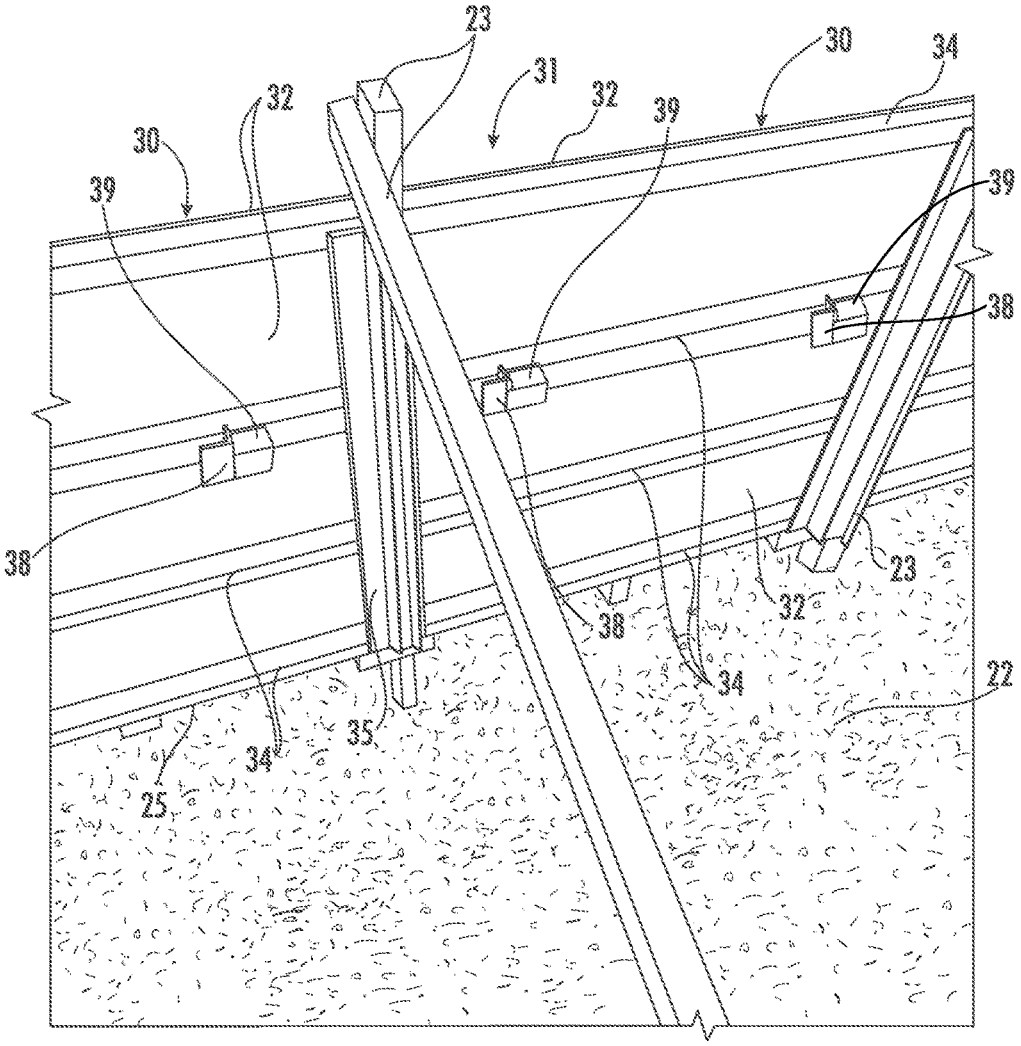
FIG. 2 is a perspective view of outer form panels according to an embodiment.
Figure 13A:
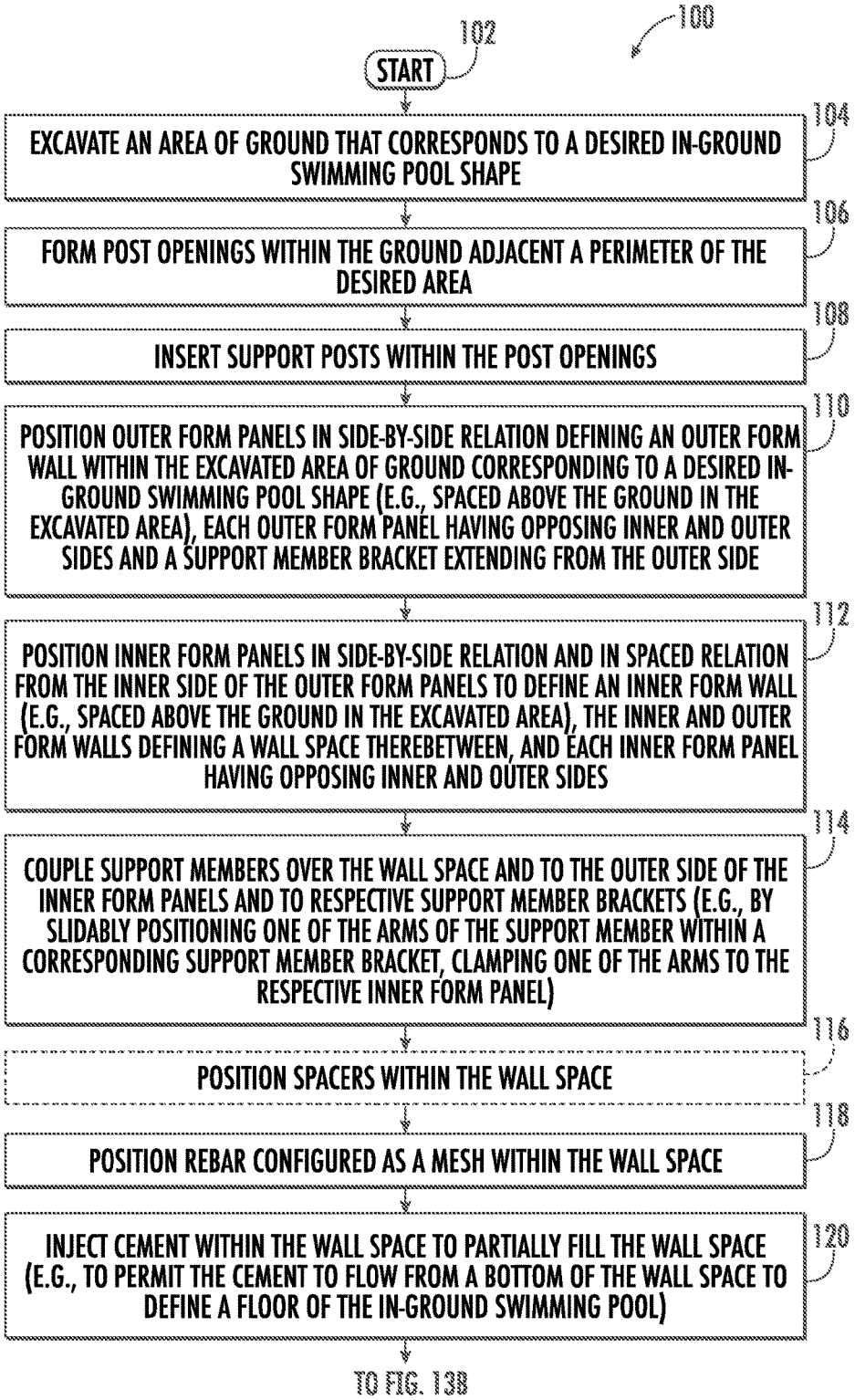
FIG. 13*a* is a flow diagram of a method of constructing an in-ground swimming pool using a form system according to an embodiment.

Referring initially to FIGS. 1-2, and the flowchart 100 in FIG. 13A, beginning at Block 102, a method of constructing an in-ground swimming pool 20 is described. At Block 104, the method includes excavating an area of ground 22 that corresponds to a desired in-ground swimming pool shape. The depth of the excavated area of ground 22 may correspond to a desired depth of the in-ground swimming pool. For example, a spa or sun-shelf may have a more shallow excavated depth, while a "deep-end" may have a corresponding deeper excavated depth. Those skilled in the art will appreciate that similar to the excavated area or plan, the depth may be excavated to be slightly deeper than the desired depths, for example, to permit plumbing, rebar, and/or other in-ground swimming pool components within the excavated area.

At Block 106, the method includes forming post openings within the ground 22 adjacent a perimeter of the desired area and inserting support posts 23 (e.g., vertically) within the post openings (Block 108). As will be appreciated by those skilled in the art, the area of ground 22 is excavated to be slightly larger than the desired size of the in-ground swimming pools so as to permit the support posts 23 to be positioned therein.

The support posts 23 may be wood, for example, 2×4. The support posts 23 may be another type or size of material.

The method further includes positioning outer form panels 30 in side-by-side relation to define an outer form wall 31 (Block 110). More particularly, each outer form panel 30 includes a smooth rigid panel 32 defining the inside of the outer form panel and spaced apart ribs 34 laterally coupled along a length of the smooth rigid panel defining the outer side of the outer form panel. The smooth rigid panel 32 and spaced apart ribs 34 may be steel, for example, galvanized steel. The smooth rigid panel 32 and spaced apart ribs 34 may each be another or different materials. Each of the spaced apart ribs 34 is illustratively in the form of a square tube, for example, having a 2"×2" size. Each of the spaced apart ribs 34 may be a different size, and the amount of spaced apart ribs may be based upon the size and shape of each outer form panel 30. For example, longer or deeper (e.g., for deeper excavated areas of the ground 22) outer form panels 30 may have four spaced apart ribs 34, while outer form panels for more shallow excavated areas, such as, for example, spas or sun-shelves, may have less than four spaced apart ribs.

Angled brackets 35 are coupled to the spaced apart ribs 34 and have an L-shape. The positioning of the outer form panels 30 in side-by-side relation to define the outer form wall 31 includes coupling, for example, using fasteners, each outer form panel to respective support posts 23. As will be appreciated by those skilled in the art the angled brackets 35 are positioned from the ends of each outer form panel so that adjacent panels are coupled to a support post 23 without spacing therebetween (e.g., sized for a 2"×4" support post).

The outer form panels 30 are coupled to the support posts 23 so that the outer form panels 30 are spaced above the excavated ground 22. In other words, there is a space 25 between the excavated ground and the bottom of each outer form panel 30. In some embodiments, fasteners, for example, threaded fasteners and nuts, may be also used to further secure adjacent outer form panels 30.

Figure 3:
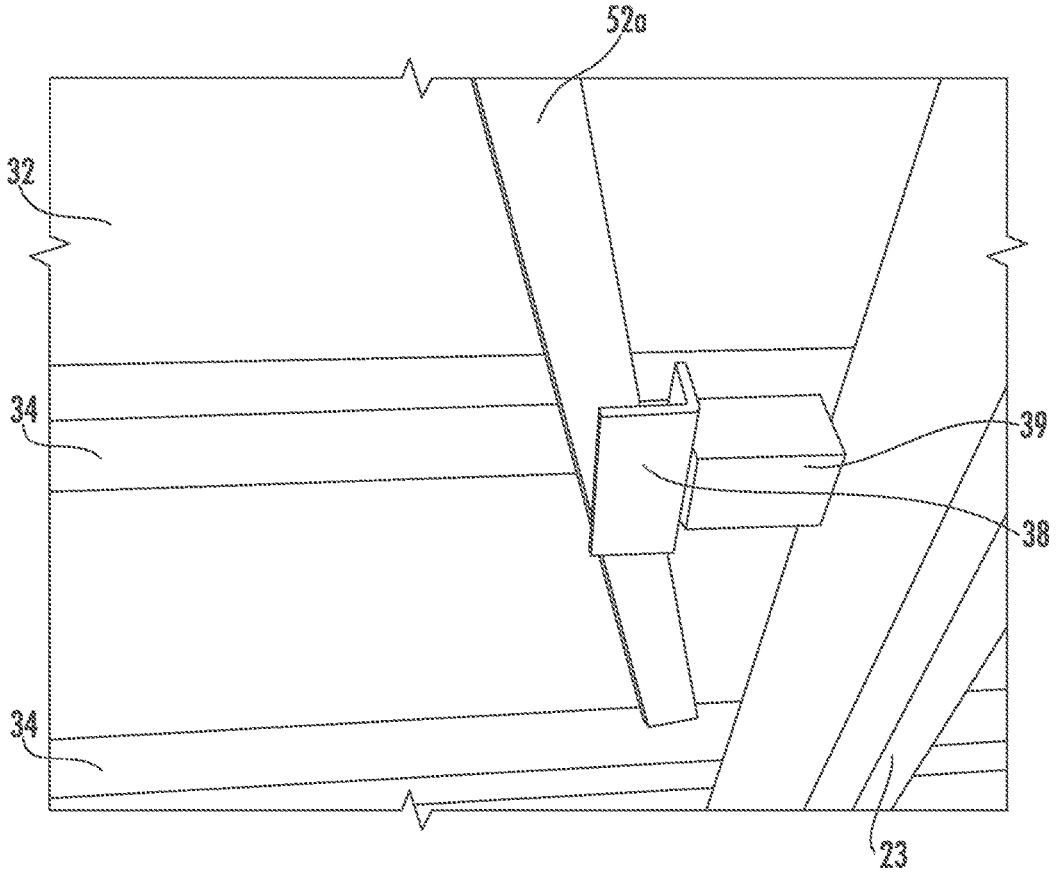
FIG. 3 is an enlarged perspective view of a portion of an outer form panel according to an embodiment.
Figure 4:
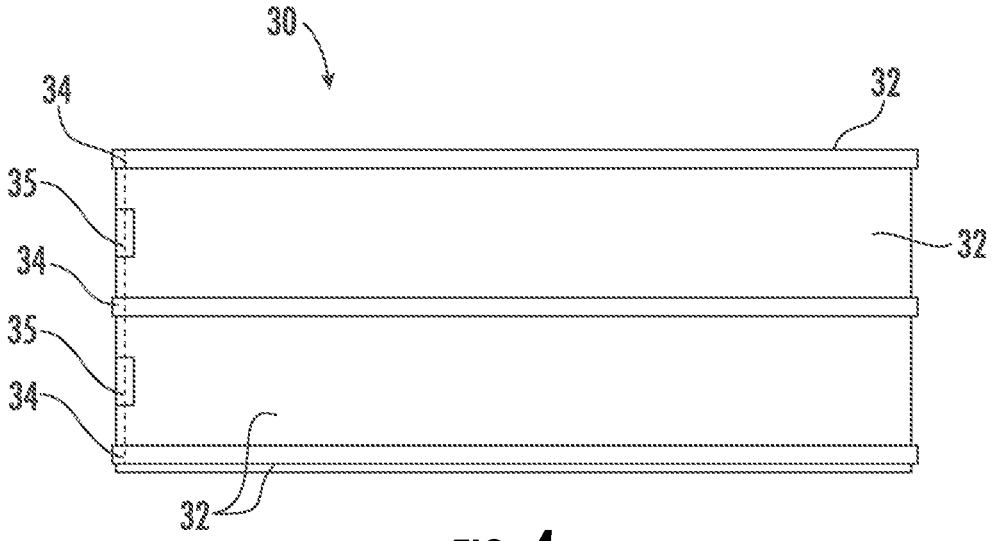
FIG. 4 is a schematic diagram of an exemplary outer form panel according to an embodiment.
Figure 5:
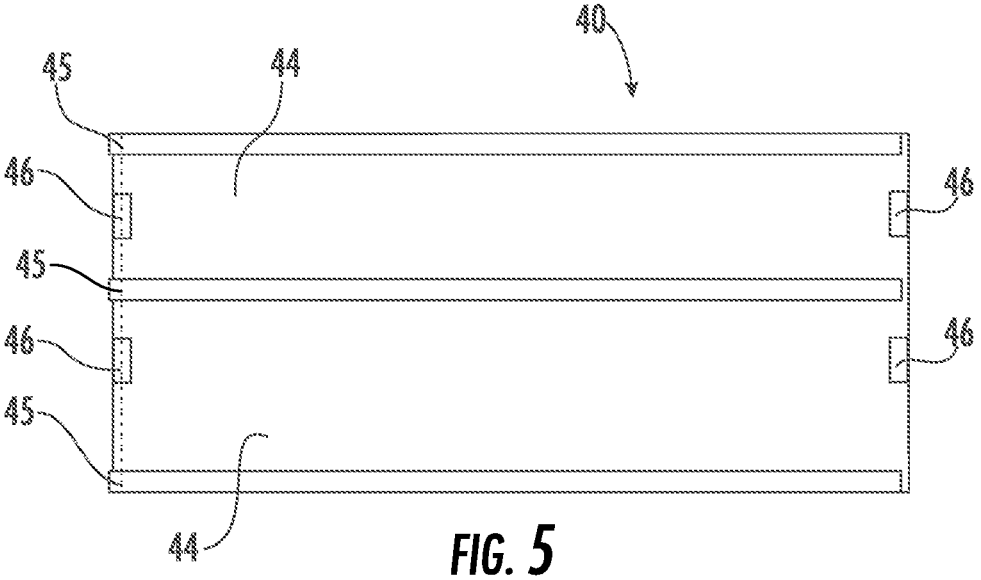
FIG. 5 is a schematic diagram of an exemplary inner form panel according to an embodiment.
Figure 6:
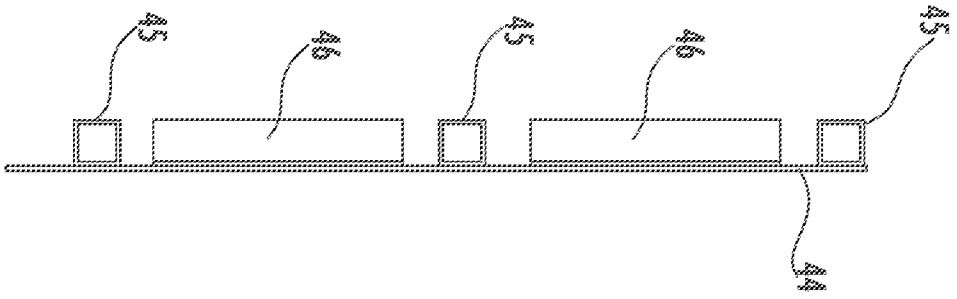
FIG. 6 is another schematic diagram of an exemplary inner form panel according to an embodiment.
Figure 7:
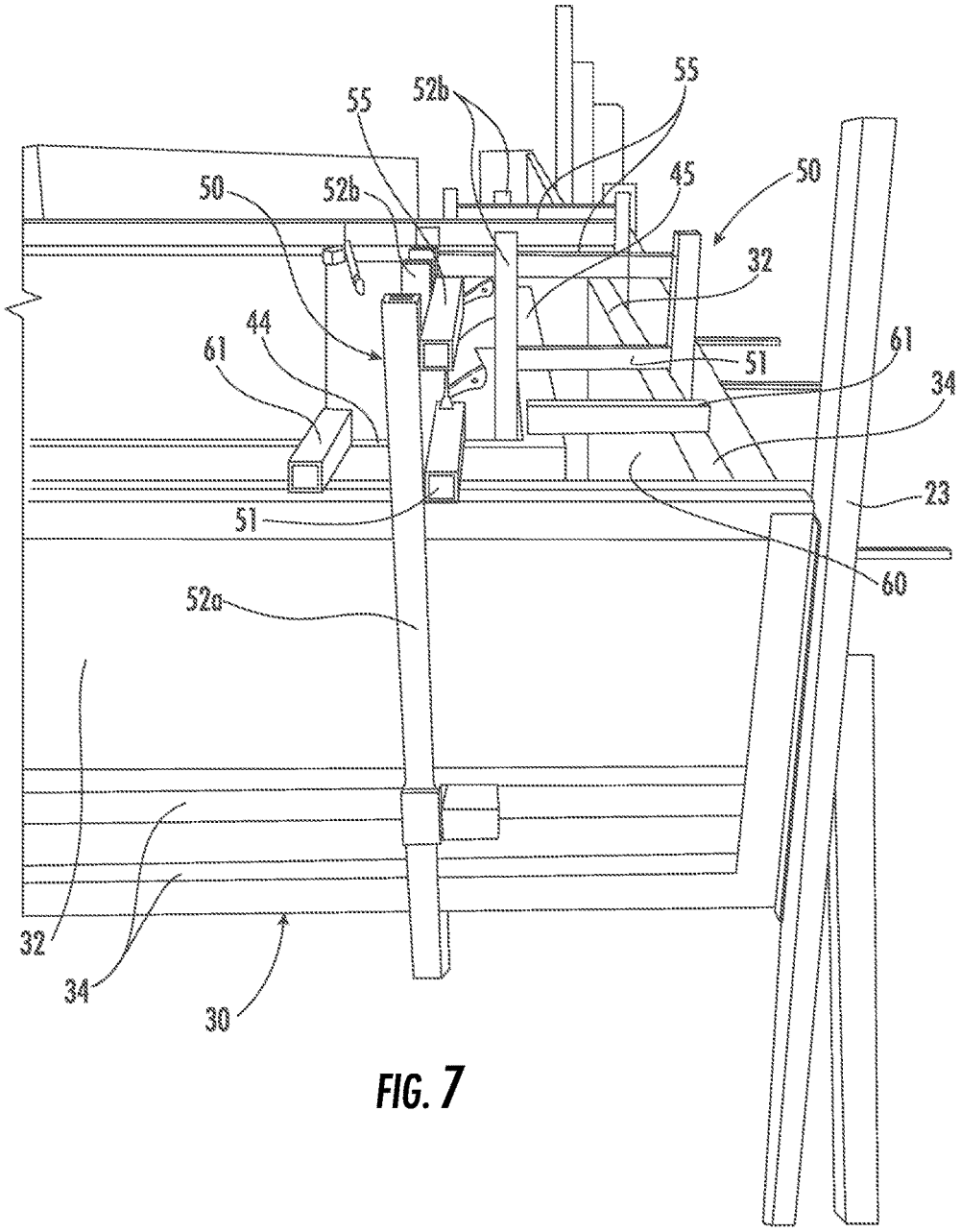
FIG. 7 is a perspective view of portions of a form system according to an embodiment.
Figure 8:
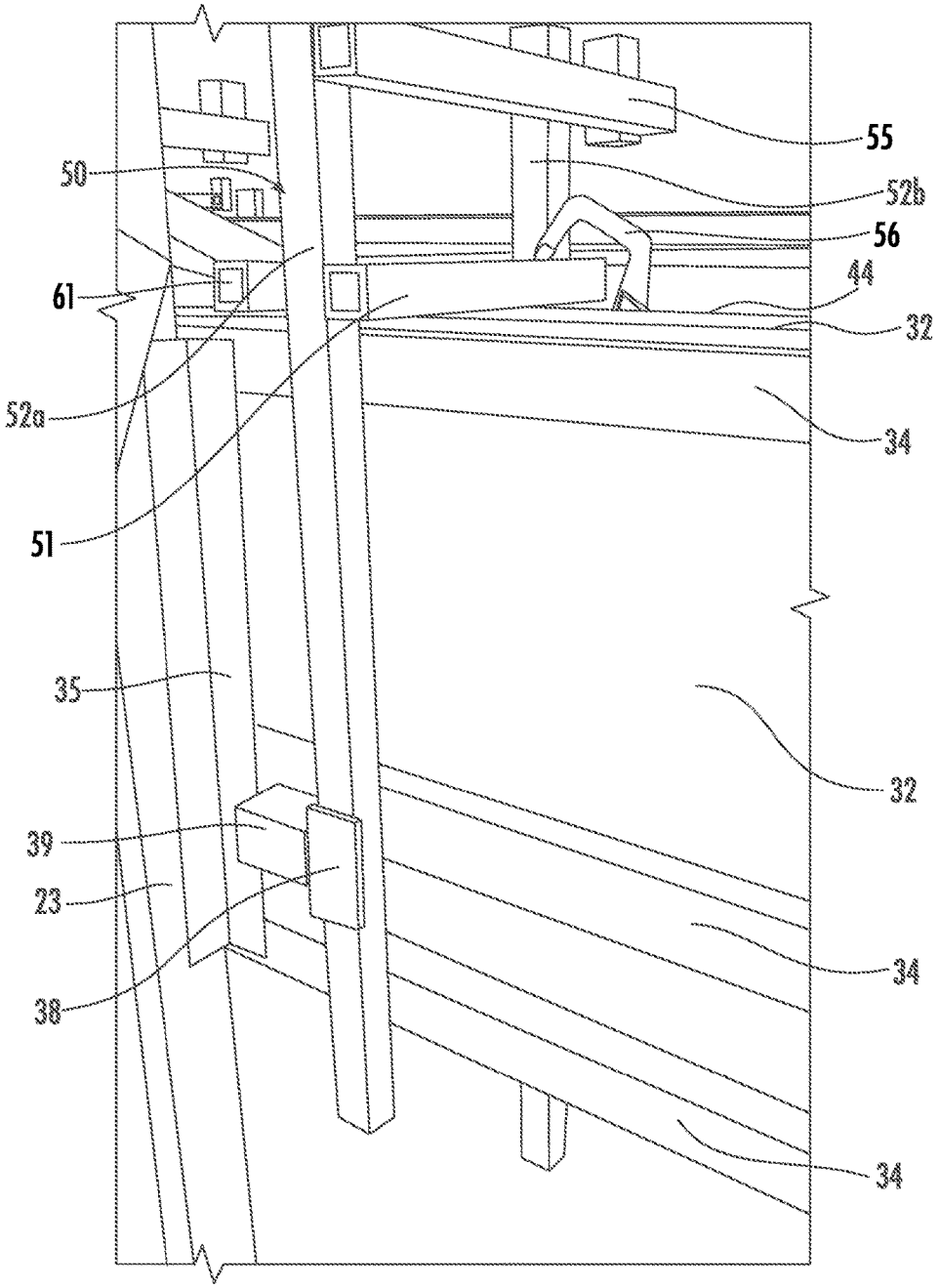
FIG. 8 is a perspective view of an outer form panel and support member according to an embodiment.
Figure 9:
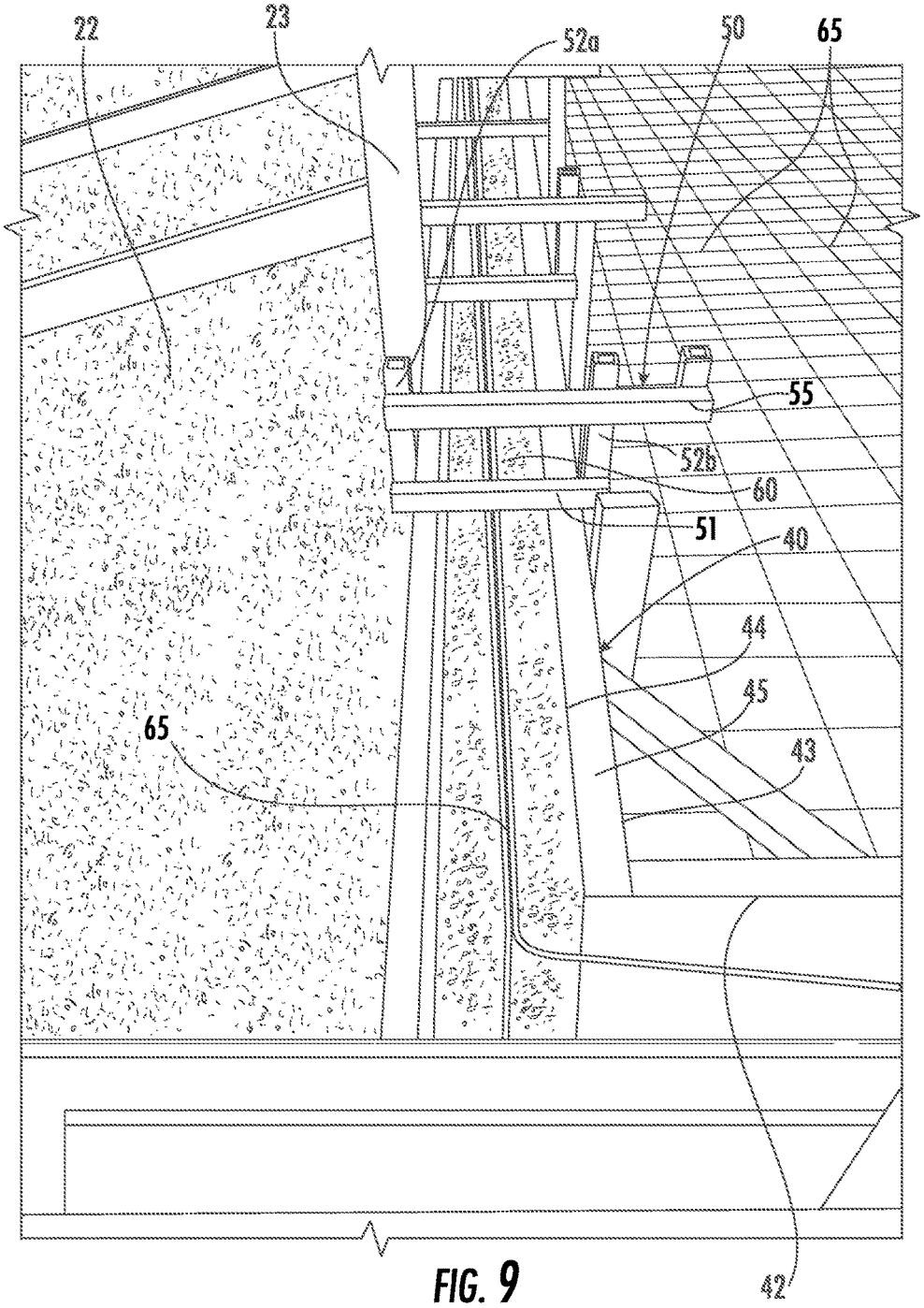
FIG. 9 is a top perspective view of a portion of a form system according to an embodiment.

Referring additionally to FIGS. 3-4, each outer form panel 30 also has opposing inner and outer sides 36, 37, the outer side corresponding to the side of the outer form panel with the spaced apart ribs 34. Each outer form panel 30 also includes a support member bracket 38 extending from the outer side 37 of each outer form panel. Each support member bracket 38 is illustratively has an L-shape so a first leg of the L-shape extends outwardly from one of the spaced apart ribs 34 (e.g., spaced from the top of each outer form panel 30, such as, the second from the top), and the other leg (traverse to the first leg) extends in a direction parallel to the plane of the smooth rigid panel 32. A respective support body 39 may be coupled to each support member bracket 38 and the corresponding spaced apart rib 34 for further support, particularly, when used with a support member 50, as will be described in further detail below.

Each outer form panel 30 may have a different size and shape so as to be coupled together to form a desired shape of an outer form wall 31 of an in-ground swimming pool. In other words, outer form panels 30 may be selected from a kit of many different sized and shaped inner form 40 panels to create a desired in-ground swimming pool shape. Moreover, while flat or planer outer form panels 30 are illustrated, those skilled in the art will appreciate that an outer form panel 30 may be curved or rounded.

Referring additionally to FIGS. 5-9, at Block 112, inner form panels 40 are positioned in side-by-side relation and in spaced relation (i.e., spaced apart) from the inner side 36 of the outer form walls 31 to define an inner form wall 41. The inner and outer form walls 31, 41 together define a wall space 60 therebetween. Similar to the outer form walls 31, each inner form wall 41 also has opposing inner and outer sides 42, 43.

Each inner form panel 40 includes a smooth rigid panel 44 defining the inner side 42 of the inner form panel and spaced apart ribs 45 laterally coupled along a length of the smooth rigid panel defining the outer side 43 of the inner form panel. The smooth rigid panel 44 and spaced apart ribs 45 may be steel, for example, galvanized steel. The smooth rigid panel 44 and spaced apart ribs 45 may each be another or different materials. Each of the spaced apart ribs 45 is illustratively in the form of a square tube, for example, having a 2"×2" size. Each of the spaced apart ribs 45 may be a different size, and the amount of spaced apart ribs may be based upon the size and shape of each inner form panel 40. For example, longer or deeper (e.g., for deeper excavated areas of the ground 22) inner form panels 40 may have four spaced apart ribs 45, while inner form panels for more shallow excavated areas, such as, for example, spas or sun-shelves, may have less than four spaced apart ribs.

In some embodiments, each inner form panel 40 may include angled brackets 46 coupled to the inside of the smooth rigid panel 44 between adjacent ribs 45. The angled brackets 46, similar to the angled brackets 35 on the outer wall panels 30, may have an L-shape. The positioning of the inner form panels 40 in side-by-side relation to define the inner form wall 41 may include coupling, for example, using fasteners 47, adjacent inner form panels using by way of the angled brackets 46. As will be appreciated by those skilled in the art the angled brackets 46 are positioned from the ends of each inner form panel 40 so that adjacent panels are coupled together in side-by-side relation without spacing therebetween.

Each inner form panel 40 may have a different size and shape so as to be coupled together to form a desired shape of an inner wall 41 of an in-ground swimming pool and to match the shape of the outer wall 31. In other words, inner form panels 40 may be selected from a kit of many different sized and shaped inner form panels to create a desired in-ground swimming pool shape. Moreover, while flat or planer inner form panels 40 are illustrated, those skilled in the art will appreciate that an inner form panel may be curved or rounded.

The method further includes, at Block 114, coupling support members 50 between the outer side 43 of respective inner form panels 40 and respective support member brackets 38. More particularly, each support member 50, which includes a base member 51 and a pair of arms 52*a*, 52*b* extending outwardly from the base to define an inverted U-shape or hump-shape, is positioned over the wall space 60. Each support member 50 may include or be formed of metal, for example, steel, and more particularly have a square tubular base member 51 and arms 52*a*, 52*b*. The square shape of the arms 52*a*, 52*b* matches the shape of the support member bracket 38 so that the arm can be received, for example, slidably, therein, or engaged with the support member bracket 38. Accordingly, one of the arms 52*b* is secured to an uppermost rib 45 of the respective inner form panel 40, for example, using a clamp 56 (e.g., a c-clamp) (FIG. 8), while the other arm 52*a* is slidably positioned within the support member bracket 38. Of course, the support members 50 including the base 51 and arms 52*a*, 52*b* may have another shape, such as a round shape, and thus, the support member bracket 38 may also have a different shape, for example, to match one of the arms 52*a*, 52*b*. Other types of securing mechanisms may be used to secure the support member 50 to the inner form panel 40.

Each support member 50 may include a further base member 55 spaced from the base member 51. In use, each support member 50 may be positioned over the corresponding outer and inner form panels 30, 40 and lowered so that the arm 52*a* engages the support member bracket 38 (which may also be referred to as an angle-iron) from the topside. The support member 50 may also be rotated or tilted so that the arm 52*a* engages the support member bracket 38 from the side (i.e., the open side of support member bracket). The support member bracket 38 secures the support member 50 so that the outer and inner form panels 30, 40 remain level and so that the support member can be secured more easily to the inner form panel. Thus, the support member 50 may be considered a type of anchor for the outer and inner form panels 30, 40. Without the support member bracket 38, the support member 50 may not sit level. For example, the arm 52*a* may be spaced from the outer form panel 30, and more particularly from the one of the ribs 45, so that the form panels will not remain level. Removal of the support member 50, for example, when desirable to remove the form panels, may include removing the clamp 56 and sliding the support member 50 upwardly or outwardly from the support member bracket 38.

As will be appreciated by those skilled in the art, the use and configuration of the support members 50 advantageously secures the inner form panels 40 and also levels the inner form wall 41 relative to the outer form wall 31. In some embodiments, support posts 23 may be inserted into the excavated ground 22 and coupled to the inner form panels 40 similar to the coupling arrangement between the support posts 23 and the outer form panels 30.

Figure 10:
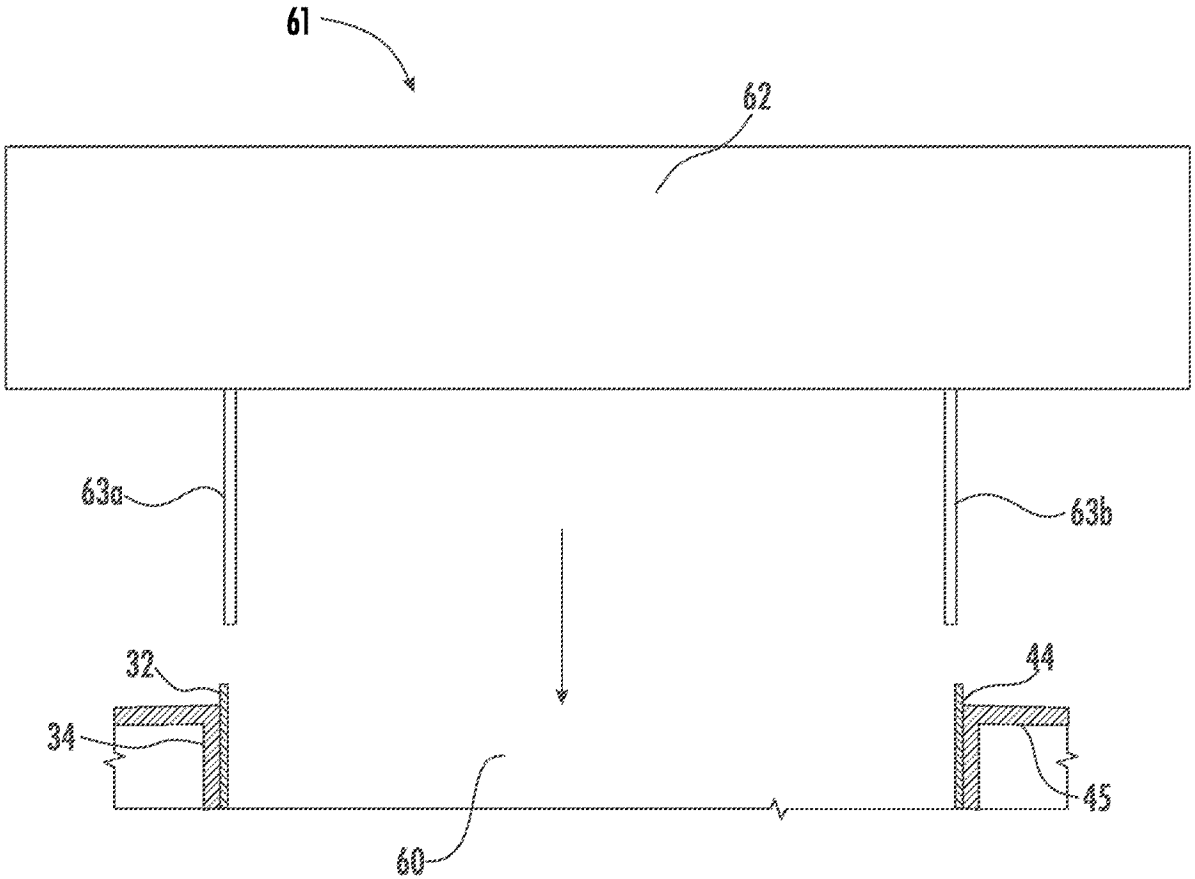
FIG. 10 is a schematic diagram of a spacer of a form system according to an embodiment.

Referring additionally to FIG. 10, spacers 61 may optionally be positioned in the wall space 60 (Block 116). The spacers 61, which may also be made of metal, and more particularly, the same material as the form panels 30, 40, each includes a base 62 and spaced apart legs 63*a*, 63*b*. The legs 63*a*, 63*b* are spaced apart to slidably fit between and in contact with the inner sides 36, 42 of the inner and outer form walls 31, 41. The spacers 61 advantageously help maintain the wall space 60. The size of the spacers 61, and more particularly, the spacing between the spaced apart legs 63*a*, 63*b* may be different and match a desired wall thickness.

Figure 11:
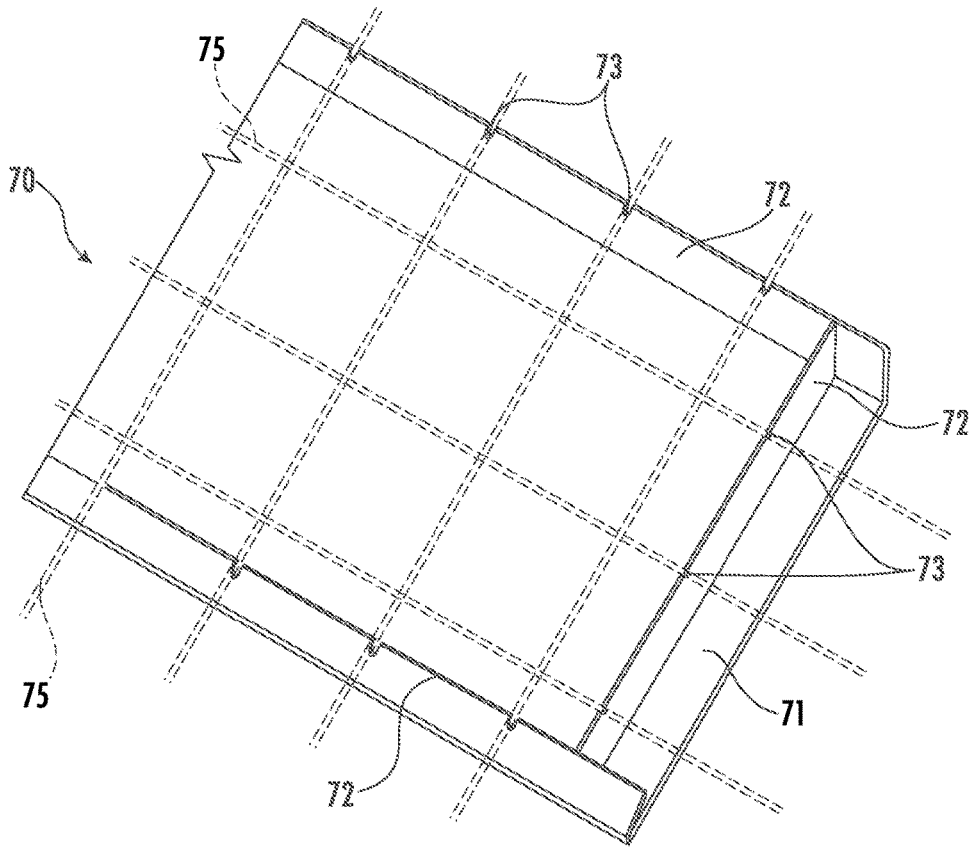
FIG. 11 is a schematic diagram of a rebar forming panel of a form system according to an embodiment.

Rebar 65 configured as a mesh may be positioned in the wall space 60 and along the excavated area bottom to define what will be the floor of the in-ground swimming pool (Block 118). Referring briefly to FIG. 11, a rebar forming panel 70 may be used to facilitate the building and setup of the mesh rebar structure. The rebar forming panel 70 includes a base panel 71 and risers 72 adjacent or along a perimeter of the base panel having recesses 73 therein spaced, for example, uniformly, about the risers.

The shape or layout of and sizing of the risers 72 corresponds to either or both of an inner and outer form panel 30, 40. The recesses 73 are sized to receive individual rebar rods 75 therein. The rebar forming panel 70, as will be appreciated by those skilled in the art, permits the rebar 65 to be pre-fabricated (i.e., not in the field or at the construction site as is conventionally done) into mesh panels. The spacing of the individual rebar rods 75 is thus done in accordance with desired building specifications and/or codes, which in turn, corresponds to quicker installation and may also reduce an amount of inspection rejections.

Figure 12:
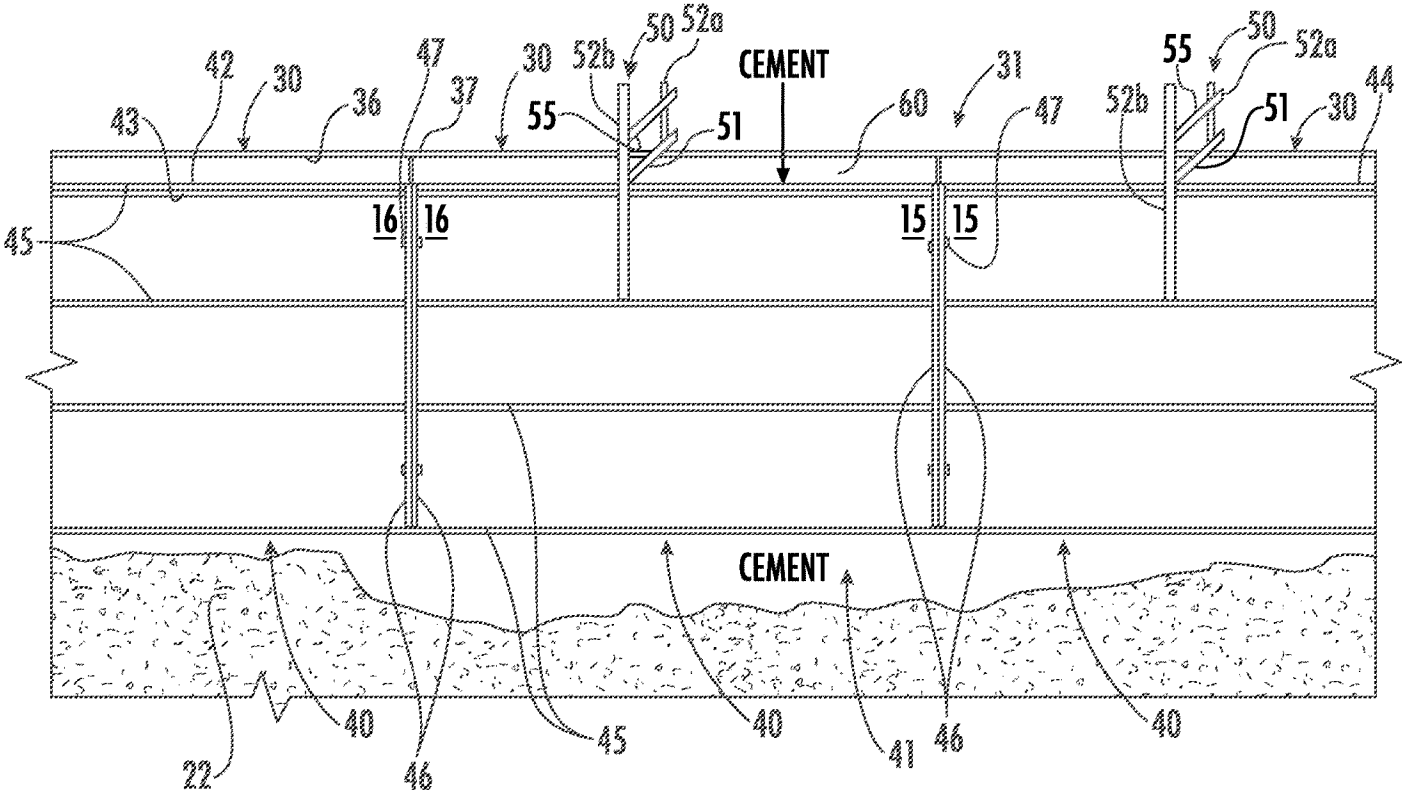
FIG. 12 is a schematic diagram illustrating cement flow in a wall space using a form system according to an embodiment.

Referring additionally to FIG. 12, at Block 120, cement, for example, concrete, is injected within the wall space 60 to partially fill the wall space. The cement, which may be sourced from a ready-mix truck, may not be sprayed, such as, for example, gunite, shotcrete, or sprayed concrete. The cement, which may be poured in the wall space 60, may be 2000-6000 psi concrete, and more particularly 4000 psi concrete. The cement is injected to partially fill the wall space 60. More particularly, the cement is injected from the top of the wall space 60 or adjacent the top of the inner and outer form walls 31, 41. As the cement is injected, it falls within the wall space 60 and, because of the spacing of the inner and outer form walls 31, 41 from the ground 22 in the excavated area, the cement will flow from the bottom of the wall space to what will be the floor of the in-ground swimming pool. Those skilled in the art will appreciate that the cement may be vibrated, for example, by hitting the inner form wall 41 with a mallet or hammer to facilitate its flow. As the cement flows, it can be troweled and curved to define a floor-to-wall transition. As the floor-to-wall transition is being formed or troweled, the cement is curing. Cement is permitted to partially, and not fully, fill the wall space 60.

Figure 13B:
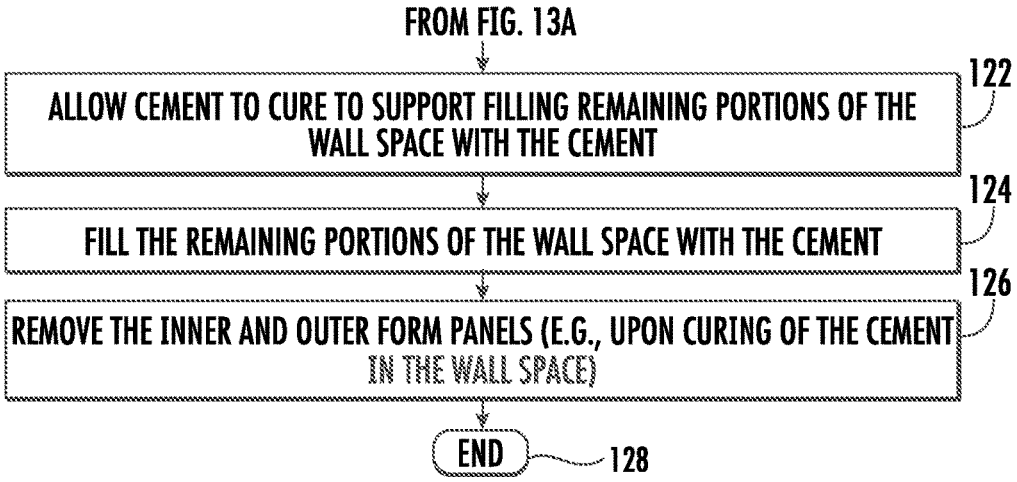
FIG. 13*b* is another flow diagram of the method of constructing the in-ground swimming pool from FIG. 13*a*.

Referring additionally to the continuation of flowchart 100 in FIG. 13B, after a sufficient curing time for the partially filled wall space 60, for example, 30-minutes (Block 122), remaining portions of the wall space 60 are filled with cement (Block 124). While 30-minutes is an exemplary curing time, it should be appreciated by those skilled in the art that the curing time may be different, for example, a sufficient curing time so as to support the weight of the cement after filling the remaining portions of the wall space 60.

At Block 126, upon curing of the remaining portions of the cement, the inner and outer form panels 30, 40 are removed exposing cement walls of the in-ground swimming pool 20, the inner side facing pool water and the outer side facing the ground. The space between the outer side of the cement pool wall and the excavated ground may be back-filled to remove that space. The method ends at Block 128.

As will be appreciated by those skilled in the art, the inner and outer form panels 30, 40 may be different sizes and shapes so that they can be configured to a desired pool shape or design. In some embodiments, the inner and/or outer form panels 30, 40 may be have numbers, letters, or other indicia thereon. The indicia may provide a reference to an installer so as to setup the inner and outer form panels 30, 40 for a particular configuration. For example, a given configurations from among a plurality thereof may be selected and correspond to a panel arrangement, for example, provided by reference guide. The inner and outer form panels 30, 40 may be configured according to the guide and corresponding to the selected configuration. This may further reduce installation time.

Accordingly, the method, and system, described herein may advantageously reduce a construction duration for an in-ground swimming pool. For example, a typical in-ground swimming pool 20 may take about three to four months to complete. The method described herein using the inner and outer form panels 30, 40 may reduce in-ground swimming pool construction to about a week. In particular, the method of constructing an in-ground swimming pool 20 using the form system described herein advantageously permits the floor and walls to be poured or constructed at what may be considered the same time (i.e., with the outer and inner form panels 30, 40 in place and, for example, on a single given day). This is in contrast to other conventional form systems that require the floor and walls to be poured or constructed over a 4-5 day period, which typically involves pouring the walls then removing the forms and then subsequently pouring the floor.

A system aspect is directed to a form system for an in-ground swimming pool 20. The form system includes outer form panels 30 in side-by-side relation defining an outer form wall 31 within an area of ground 22 corresponding to a desired in-ground swimming pool shape. Each outer form panel 30 has opposing inner and outer sides 36, 37 and a support member bracket 38 extending from the outer side. The form system also includes inner form panels 40 in side-by-side relation and in spaced relation from the inner side 42 of the inner form panels 40 to define an inner form wall 41. The inner and outer form walls 31, 41 define a wall space 60 therebetween, and each inner form panel 40 has inner and outer sides 42, 43. The form system also includes support members 50 over the wall space 60 and coupled to an outer side 43 of the inner form panels 40 and to respective ones of the support member brackets 38.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of constructing an in-ground swimming pool comprising:

positioning a plurality of outer form panels in side-by-side relation to define an outer form wall within an excavated area of ground corresponding to a desired in-ground swimming pool shape, each outer form panel having opposing inner and outer sides and comprising an outer smooth rigid panel, a plurality of spaced apart longitudinal outer ribs coupled to the outer smooth rigid panel defining the outer side of the outer form panel, and a support member bracket carried by a given one of the plurality of spaced apart longitudinal outer ribs;

positioning a plurality of inner form panels in side-by-side relation and in spaced relation from the inner side of the plurality of outer form panels to define an inner form wall, the inner and outer form walls defining a wall space therebetween, and each inner form panel having opposing inner and outer sides; and coupling a plurality of tubular support members over the wall space and to the outer side of the plurality of inner form panels and to respective ones of the plurality of support member brackets, each tubular support member comprising a tubular base member and a plurality of tubular arms extending outwardly from the tubular base member, each tubular support member being coupled so that the tubular base member extends across the wall space adjacent an uppermost one of the plurality of longitudinal outer ribs and so that one of the tubular support arms extends across the uppermost longitudinal outer rib to be slidably received between adjacent portions of the corresponding support member bracket and the given longitudinal outer rib.

2. The method of claim 1 further comprising removing the plurality of outer and inner wall panels.

3. The method of claim 1 wherein coupling the plurality of support members comprises clamping one of the plurality of arms to a respective one of the plurality of inner form panels.

4. The method of claim 1 further comprising positioning a plurality of spacers within the wall space to maintain spacing between the plurality of inner and outer wall panels.

5. The method of claim 1 further comprising excavating the ground prior to positioning the plurality of outer and inner form panels to define the excavated area.

6. The method of claim 1 further comprising injecting cement within the wall space to partially fill the wall space.

7. The method of claim 6 further comprising:

allowing the cement to cure to support filling remaining portions of the wall space with the cement; and filling the remaining portions of the wall space with the cement.

8. The method of claim 7 further comprising removing the plurality of inner and outer wall panels based upon curing of the cement within the remaining portions of the wall space.

9. The method of claim 6 wherein positioning the plurality of outer and inner form panels comprises positioning the plurality of outer and inner form panels to be spaced above the ground in the excavated area; and wherein injecting the cement within the wall space to partially fill the wall space comprises injecting cement within the wall space to permit the cement to flow from a bottom thereof to define a floor of the in-ground swimming pool.

10. The method of claim 1 further comprising:

forming a plurality of post openings in the ground adjacent a perimeter of the desired in-ground swimming pool shape;

inserting a plurality of support posts within the plurality of post openings; and coupling the plurality of outer form panels to the plurality of support posts.

11. A method of constructing an in-ground swimming pool comprising:

forming a plurality of post openings adjacent a perimeter of an excavated area of ground corresponding to a desired in-ground swimming pool shape;

inserting a plurality of support posts within the plurality of post openings;

coupling a plurality of outer form panels defining an outer form wall to the plurality of support posts and within the excavated area of ground corresponding to the desired in-ground swimming pool shape, each outer form panel having opposing inner and outer sides and a support member bracket extending from the outer side, the plurality of outer form panels being coupled to the plurality of support posts so that the outer form wall is spaced above the ground in the excavated area;

positioning a plurality of inner form panels in spaced relation from the inner side of the plurality of outer form panels to define an inner form wall, the inner and outer form walls defining a wall space therebetween, and each inner form panel having opposing inner and outer sides, the plurality of inner form panels being positioned so that the inner form wall is spaced above the ground in the excavated area;

coupling a plurality of support members over the wall space and to the outer side of the plurality of inner form panels and to respective ones of the plurality of support member brackets;

injecting cement within the wall space so that the cement initially flows through the wall space to the ground in the excavated area to define a floor of the in-ground swimming pool and accumulates in the wall space; and removing the plurality of outer and inner wall panels upon curing of the cement.

12. The method of claim 11 wherein each of the plurality of support members comprises a base member and a plurality of arms extending outwardly from the base member.

13. The method of claim 12 wherein coupling the plurality of support members to respective ones of the plurality of support member brackets comprises slidably positioning one of the plurality of arms within a corresponding one of the support member brackets.

14. The method of claim 12 wherein coupling the plurality of support members to the inner side of the plurality of inner form panels comprises clamping one of the plurality of arms to a respective one of the plurality of inner form panels.

15. The method of claim 11 further comprising positioning a plurality of spacers within the wall space to maintain spacing between the plurality of inner and outer wall panels.

16. A form system for an in-ground swimming pool comprising:

a plurality of outer form panels to be coupled in side-by-side relation to define an outer form wall within an area of ground corresponding to a desired in-ground swimming pool shape, each outer form panel having opposing inner and outer sides and comprising an outer smooth rigid panel, a plurality of spaced apart longitudinal outer ribs coupled to the outer smooth rigid panel defining the outer side of the outer form panel, and a support member bracket carried by a given one of the plurality of spaced apart longitudinal outer ribs;

a plurality of inner form panels to be coupled in side-by-side relation and in spaced relation from the inner side of the plurality of outer form panels to define an inner form wall, the inner and outer form walls to define a wall space therebetween, and each inner form panel having inner and outer sides; and a plurality of tubular support members to be coupled over the wall space and coupled to the outer side of the plurality of inner form panels and to respective ones of the plurality of support member brackets, each tubular support member comprising a tubular base member and a plurality of tubular arms extending outwardly from the tubular base member, each tubular base member having a base member length so that when coupled to adjacent inner and outer form panels, the base member extends across the wall space adjacent an uppermost one of the plurality of longitudinal outer ribs, and at least one tubular support arm of the plurality thereof having an arm length so that when coupled to the adjacent inner and outer form panels, the at least one arm extends across the uppermost longitudinal outer rib for being slidably received between adjacent portions of the corresponding support member bracket and the given longitudinal outer rib.

17. The form system of claim 16 further comprising a corresponding clamping device for coupling each of the plurality of tubular support members to a respective one of the plurality of inner form panels.

18. The form system of claim 16 further comprising a plurality of spacers to be positioned within the wall space to maintain to the spacing between the plurality of inner and outer wall panels.

* * * * *